United States Patent [19]

Witting

[11] Patent Number: 4,871,946

[45] Date of Patent: Oct. 3, 1989

[54] ELECTRODELESS HIGH INTENSITY DISCHARGE LAMP

[75] Inventor: Harald L. Witting, Burnt Hills, N.Y.

[73] Assignee: General Electric Company, Schenectady, N.Y.

[21] Appl. No.: 168,032

[22] Filed: Mar. 14, 1988

[51] Int. Cl.[4] ..... H05B 41/16

[52] U.S. Cl. ..... 315/248; 315/256; 315/39; 315/229

[58] Field of Search ..... 315/248, 39, 267, 344, 315/239, 344; 313/229, 225

[56] References Cited

U.S. PATENT DOCUMENTS

| | | | |
|---|---|---|---|
| 3,763,392 | 10/1973 | Hollister | 315/248 |
| 3,860,854 | 1/1975 | Hollister | 315/248 |
| 3,942,058 | 3/1976 | Haugsjaa et al. | 313/44 |
| 3,943,404 | 3/1976 | McNeill et al. | 315/39 |
| 4,178,534 | 12/1979 | Mc Neill et al. | 315/248 |
| 4,206,387 | 6/1980 | Kramer et al. | 315/248 |

FOREIGN PATENT DOCUMENTS

| | | | |
|---|---|---|---|
| 369649 | 4/1973 | U.S.S.R. | 315/256 |

*Primary Examiner*—Leo H. Boudreau
*Assistant Examiner*—Michael Razavj
*Attorney, Agent, or Firm*—Jill M. Breedlove; James C. Davis, Jr.; Marvin Snyder

[57] ABSTRACT

An electrodeless high intensity arc discharge lamp employs an excitation coil comprised of a high-temperature metal, such as tungsten or molybdenum, wound directly on the hot quartz envelope of the arc tube within the interior of the outer glass envelope of the lamp, thereby requiring substantially lower current and voltage from the power supply than such lamps having external excitation coils, while emitting less electromagnetic noise. The excitation coil losses are comparable to those of the external excitation coils or prior electrodeless high intensity arc discharge lamps.

6 Claims, 1 Drawing Sheet

ELECTRODELESS HIGH INTENSITY DISCHARGE LAMP

BACKGROUND OF THE INVENTION

The invention relates to high intensity discharge (HID) lamps, and more particularly to an electrodeless HID lamp employing a high-temperature excitation coil.

In an electrodeless HID lamp, a light emitting ring-shaped arc discharge is induced in a gas-containing or plasma-containing arc tube by a radio-frequency electric current in an excitation coil surrounding the tube. High temperatures (above 1000° C.) are required in the arc tube to prevent the gas from condensing, yet the coil must not be subjected to temperatures that approach its melting point. HID lamp induction coils of prior art design, typically made of copper, must not be exposed to temperatures of more than approximately 200° C. above room temperature to prevent excessive resistive losses in the coil and to prevent coil oxidation in the ambient air. This is accomplished by coil cooling. Home, the cooling requirement is difficult to meet in a commercial lamp that must be limited in cost, size and power input. A cool coil also requires adequate insulation between the arc tube and the coil; otherwise, the heat load on the coil can become excessive, and the temperature of the arc tube is likely to fall below approximately 1000° C. with attendant condensation of the vapors in the arc tube. Therefore, the induction coil of prior art HID lamps is located external to the lamp envelope, and the envelope is separated from the arc tube by a layer of insulation. These intervening insulating layers lead to effective coil diameters that are much larger than the arc diameter, causing poor coupling and high coil currents which result in high power losses in the coil and in the power supply ballast.

OBJECTS OF THE INVENTION

It is therefore an object of the invention to provide an electrodeless HID lamp having an excitation coil capable of operating at the high temperature of the arc tube without excessive resistive power losses.

Another object of the invention is to provide for an electrodeless HID lamp an excitation coil that does not require separate cooling.

Another object of the invention to provide a new and improved electrodeless HID lamp having an excitation coil requiring minimal current and voltage from its power supply.

Another object of the invention is to provide a new and improved electrodeless HID lamp with an excitation coil situated within the glass envelope of the lamp.

SUMMARY OF THE INVENTION

An electrodeless high intensity discharge lamp includes an outer envelope which encases an arc tube containing fill material capable of forming al light-emitting plasma upon excitation. An excitation coil surrounding the tube induces a magnetic field therein which interacts with the fill to produce a light-emitting, ring-shaped arc discharge. The excitation coil is structured so as to minimize blockage of light emitted by the ring-shaped arc, while optimizing the magnetic flux coupling between the coil and the arc discharge. Additionally, the invention minimizes resistive power losses in the coil, consequently minimizing resistive power losses in the lamp.

In a preferred embodiment of the invention, the excitation coil is wound directly on and around the arc tube and is formed of conductor having a relatively small cross-sectional area. By utilizing a high melting point, low resistivity, low vapor pressure metal as the conductor, no separate cooling is required for the coil. By situating the coil in close proximity to the arc tube, the coil diameter can be made small, thereby minimizing power losses in the coil and therefore in the lamp.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

DETAILED DESCRIPTION OF THE INVENTION

Figure 1:
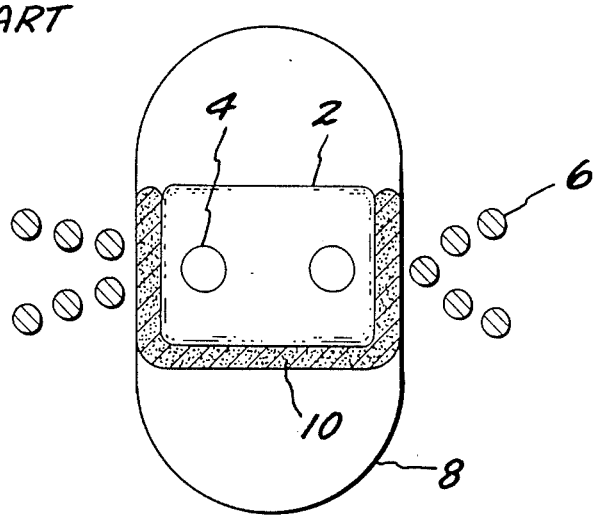
FIG. 1 PRIOR ART
FIG. 1 illustrates, in side cross-sectional view, a prior art embodiment of an electrodeless HID lamp with an external hourglass-shaped excitation coil.

In FIG. 1, a prior art lamp of the type described and claimed in J. M. Anderson U.S. Pat. No. 4,812,702 issued Mar. 14, 1989 and assigned, to the instant assignee, is illustrated. The Anderson application is hereby incorporated by reference. The lamp of prior art FIG. 1 comprises an arc tube 2, typically comprised of quartz, mounted within a glass envelope 8 which is surrounded by an external, air core induction coil 6. The coil is formed in the shape of an hourglass to minimize blockage of light from the arc ring. The volume enclosed by arc tube 2 contains a quantity of at least one gas, such as a metal halide, in which a discharge arc plasma 4 is induced in response to flow of a radio-frequency (RF) current in excitation coil 6. The RF current is produced by an excitation power source (not shown) connected to coil 6. An inert gas may also be included in the arc tube to serve as a diffusion barrier to prevent heat loss at the walls of arc tube 2. Typically, the discharge arc plasma 4, constituting the light source, takes the shape of a toroidal ring, or "doughnut". Induction coil 6 is comprised of a high-conductivity material, such as copper, in order to minimize the resistive power loss in the coil. Being situated outside envelope 8, the coil operates at a temperature that is elevated slightly above room temperature. A layer of insulation 10 may be included outside the arc tube along the sides and on the bottom surface thereof, in order to minimize heat loss from within the arc tube.

A basic requirement of the prior art coil design shown in FIG. 1 is the need for coil cooling in order to prevent the temperature of coil 6 from rising to more than about 200° C. above room temperature. This cooling prevents excessive resistive losses in the coil, and is especially effective since the coil resistivity increases with temperature. The cooling also inhibits oxidation of coil 6 in the ambient air.

In the prior art lamp shown in FIG. 1, keeping coil 6 cool requires adequate insulation between arc tube 2 and the coil, for if the heat load on the coil should become excessive it would cause an increase in coil resistivity, and also the temperature of the arc tube would fall low enough to cause condensation of the vapors in the arc tube. For this reason, induction coil 6 is located external to the lamp envelope 8 and lamp envelope 8 is preferably separated from arc tube 2 by a layer of insulation 10, such as glass wool. However, these intervening layers lead to effective coil diameters that are much larger than the diameter of arc discharge 4, causing poor inductive coupling and high coil currents. For example, for an arc of 12 mm diameter in an arc tube of 20 mm outside diameter (OD), the effective diameter of induction coil 6 is typically 38 mm. This large coil diameter leads to high coil currents, which result in high power losses in the coil and in the power supply ballast (not shown).

Figure 2:
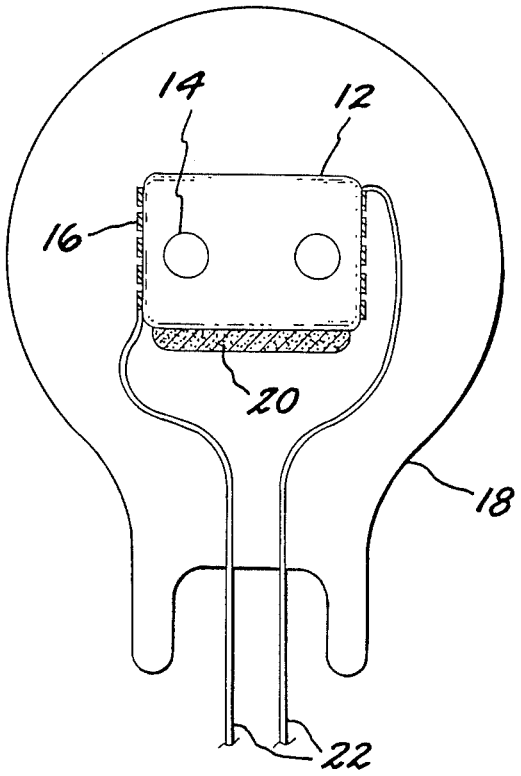
FIG. 2 illustrates a cross-sectional view of a new and improved electrodeless HID lamp having a high temperature excitation coil wound directly on the arc tube of the lamp.

In the preferred embodiment of the invention, as shown in FIG. 2, an rf current at a frequency in the range of 1 to 100 MHz in a gas core induction coil 16 induces a ring-shaped plasma arc discharge 14 within a cylindrical arc tube 12 which is typically comprised of quartz and contains a fill comprised of at least one gas, such as a metal halide. In this embodiment, a ribbon of high-temperature metal (i.e., exhibiting a melting point above 1000° C. and a vapor pressure of less than $10^{-8}$ torr at 1000° C.), having a resistivity of less than $50\times10^{-6}$ ohm-cm at 1000° C., is wound directly around arc tube 12 in a spiral, to serve as the excitation coil 16 for the lamp. A metal suitable for use in induction coil 16 may typically comprise a refractory metal such as tungsten or molybdenum.

Arc tube 12 and high temperature excitation coil 16 are enclosed in outer glass envelope 18. Conventional electrical connections may be made through leads 22 at the lamp base (not shown). A heat shield 20, such as glass wool, may be attached to the bottom of arc tube 12 if necessary. The heat shield is not likely to be needed along the sides of arc tube 12, however, because resistive heat from coil 16 will help to maintain a high arc tube temperature in that area which, as previously pointed out, is needed to prevent the gases in the arc tube from condensing. Light is emitted primarily from the top of arc tube 12.

High temperature excitation coil 16 is much smaller in diameter than the prior art induction coil employed in the lamp shown in FIG. 1. For example, for an arc discharge 14 of 12 mm diameter in the lamp of FIG. 2, the diameter of coil 16 can be the same as the outer diameter, 20 mm, of arc tube 12. The thickness of the coil ribbon need not be much more than the skin depth (less than 0.1 mm at a frequency of 13.56 MHz, for example).

Coil 16 avoids undergoing excessive resistive heat losses even though at a temperature of 1000° C. the resistivity of the high temperature metal employed therein is much higher than that of the copper employed in the excitation coils of prior art lamps where such coils are desirably operated at temperatures not much above room temperature. For instance, the 32 micro-ohm-cm resistivity of tungsten at 1000° C. exceeds the 1.7 micro-ohm-cm resistivity of copper at 22° C. by a factor of almost 19. If all other effects were equal, the higher resistivity of the high-temperature excitation coil would lead to unacceptable resistive heat losses. However, in the high-temperature coil, this factor of almost 19 in higher resistivity is more than compensated for by three effects that reduce the resistive losses relative to the prior art coil. These three effects are skin depth, coupling efficiency and coil length. The higher resistivity of high-temperature coil 16 increases the skin depth, and therefore reduces the coil resistance. The smaller diameter attainable by the high-temperature coil allows increased coupling efficiency and therefore a reduction in coil current and coil losses. This reduced diameter results in a reduced coil length and therefore a reduced coil resistance.

The effects of skin depth, coupling efficiency and coil length in a relevant example may be illustrated by comparing a prior art excitation coil (e.g., coil 6 shown in FIG. 1) with high temperature excitation coil 16 of the lamp shown in FIG. 2. In both instances, an arc discharge of 12 mm effective diameter is produced when operating the coil at an excitation frequency of 13.56 MHz and power of 120 watts (24V at 5A) in an arc tube of 20 mm OD and 17 mm height. Both the prior art coil and the high-temperature coil have five turns and each turn has an effective width (measured along the axial dimension of the coil) of 2 mm. Separation between adjacent turns of the high temperature coil is approximately 0.5 mm. The prior art coil has an effective diameter of 38 mm, while the high temperature coil has a 20 mm diameter and a resistivity that is approximately 19 times that of the prior art coil.

Skin depth in a conductor is proportional to the square root of the resistivity. Therefore, skin depth of the high-temperature coil 16 is a factor of $\sqrt{19}=4.3$ greater than that of the prior art coil 6, and resistance of the high-temperature coil is lower by the same factor.

The required coil current is determined by the need to provide to the plasma enough voltage by induction to sustain the discharge voltage. This requires a specific magnitude of magnetic field at a given frequency. The required coil current to produce this specific magnetic field is proportional to the effective coil diameter. The resistive power loss in the coil is proportional to the square of the current, i.e., to the square of the coil diameter. Therefore, the power loss of the high-temperature coil is a factor of $(38/20)^2=3.6$ lower than that of the prior art coil due to the better coil coupling exhibited by the high-temperature coil. Because the coil resistance is directly proportional to the coil diameter, the high-temperature coil also exhibits a factor of $(38/20)=1.9$ lower coil resistance due to its smaller diameter.

By combining the factors determined above, the ratio of resistive power dissipation in the high-temperature coil relative to the prior art coil is equal to (resistivity ratio)/(power loss ratio) (skin depth ratio) (resistance ratio) or $19/(3.6)(4.3)(1.9)=0.63$. This resistive power dissipation ratio indicates that the high-temperature excitation coil dissipates 37% less resistive power than the prior art excitation coil.

High-temperature excitation coil 16 shown in FIG. 2 not only conducts reduced current compared to the excitation coil of the prior art, but also has a much reduced voltage requirement due to its lower coil current and coil inductance. These effects considerably reduce the cost and power dissipation of the lamp power supply, as well as the radiated electromagnetic noise.

The foregoing describes an electrodeless HID lamp having an excitation coil situated within the glass envelope of the lamp and capable of operating at the high temperature of the arc tube without excessive coil resistive power losses and without need for separate coil cooling. This facilitates an integral lamp design that combines lamp and coil within an outer glass envelope, with conventional current connections at the base. The lamp requires minimal current and voltage from its power supply.

While only certain preferred features of the invention have been illustrated and described herein, many modifications and changes will occur to those skilled in the art. It is, therefore, to be understood that the appended claims are intended to cover all such modifications and changes as fall within the true spirit of the invention.

What I claim is:

1. An electrodeless high intensity discharge lamp, comprising:

an outer transparent envelope;

a light-transmissive arc tube situated within, and spaced from, said envelope;

an excitation coil is wound directly on said arc tube and comprised of a high-temperature metal situated within said envelope and surrounding said arc tube, said excitation coil having a first end and a second end and being wound around the sides of said arc tube so as to avoid obstructing light emanating from the top of said arc tube;

said arc tube encasing a fill material capable of forming a substantially toroidal light-emitting plasma arc discharge upon predetermined excitation of said coil; and conductive means providing electrical connection from the exterior of said envelope to the first end and the second end of said excitation coil.

2. The electrodeless high intensity discharge lamp of claim 2 wherein said coil is wound of a ribbon-shaped conductor.

3. The electrodeless high intensity discharge lamp of claim 1 wherein said metal comprises one of the group consisting of tungsten and molybdenum.

4. The electrodeless high intensity discharge lamp of claim 2 further including heat shield means situated at the bottom of said arc tube.

5. The electrodeless high intensity discharge lamp of claim 4 wherein said coil is wound of a ribbon-shaped conductor.

6. The electrodeless high intensity discharge lamp of claim 5 wherein said metal exhibits a resistivity of less than $50\times10^{-6}$ ohm-cm at temperature of 1000° C.

* * * * *

UNITED STATES PATENT AND TRADEMARK OFFICE

CERTIFICATE OF CORRECTION

PATENT NO. : 4,871,946

DATED : October 3, 1989

INVENTOR(S) : Harald L. Witting

It is certified that error appears in the above-identified patent and that said Letters Patent is hereby corrected as shown below:

Column 1, line 24, before ", the cooling requirement", "Home" is deleted and -- However -- is substituted therefor.

Column 1, line 60, after "capable of forming", "al" is deleted and "a" is substituted therefor.

Signed and Sealed this

Seventeenth Day of December, 1991

*Attest:*

HARRY F. MANBECK, JR.

*Attesting Officer*

*Commissioner of Patents and Trademarks*